United States Patent [19]

Simizu et al.

[11] Patent Number: 5,023,163

[45] Date of Patent: Jun. 11, 1991

[54] MONOSHEET SELF-PROCESSING FILM UNIT AND METHOD OF MAKING THE SAME

[75] Inventors: Tooru Simizu; Hideaki Kataoka, both of Minami-Ashigara, Japan

[73] Assignee: Fuji Photo Film Co., Ltd., Kanagawa, Japan

[21] Appl. No.: 349,241

[22] Filed: May 9, 1989

[30] Foreign Application Priority Data

May 9, 1988 [JP] Japan ..... 62-111805
Jun. 24, 1988 [JP] Japan ..... 63-83769[U]

[51] Int. Cl.[5] ..... G03C 5/54; G03C 1/96

[52] U.S. Cl. ..... 430/207; 430/208; 430/209; 430/498

[58] Field of Search ..... 430/207, 208, 209, 498; 354/304; 156/204–324, 269, 261

[56] References Cited

U.S. PATENT DOCUMENTS

| | | | |
|---|---|---|---|
| 4,273,852 | 6/1981 | Lange et al. | 430/209 |
| 4,312,939 | 1/1982 | McCole | 430/207 |
| 4,352,879 | 10/1982 | Hara | 430/209 |
| 4,490,456 | 12/1984 | Feasey | 430/210 |
| 4,556,631 | 12/1985 | Sato et al. | 430/209 |

*Primary Examiner*—Charles L. Bowers, Jr.
*Assistant Examiner*—Thorl Chea
*Attorney, Agent, or Firm*—Young & Thompson

[57] ABSTRACT

A monosheet type self-processing film unit comprising a masking member formed with an image area defining opening, a photosensitive sheet, a developer containing pod, a trapping member, a transparent cover sheet, and a spacer member interposed between the photosensitive and transparent cover sheets. A method of making the same comprises the steps of attaching pods and trapping members to opposite edges on one surface of a long sheet, punching out a series of image area defining openings in the long sheet between each pair of the paired pods and trapping members, attaching a web-like photosensitive sheet to the long sheet, attaching both ends of a spacer member longer than the width of the photosensitive sheet to the one surface of the long sheet between the adjacent two image area defining openings, attaching a web-like transparent sheet onto the one surface of the long sheet, folding both sides of the long sheet so as to enclose the pods and the trapping members, respectively, and cutting the long sheet overlapping with and interposed between the photosensitive and transparent sheets along a center line of each spacer member to separate film units.

9 Claims, 6 Drawing Sheets

MONOSHEET SELF-PROCESSING FILM UNIT AND METHOD OF MAKING THE SAME

BACKGROUND OF THE INVENTION

The present invention relates to a monosheet type self-processing photographic film unit and a method of making the same.

In recent years, monosheet-type self-processing photographic film units (which are referred hereinafter to simply as film units) have become increasingly popular. Such a film unit has an image-receiving sheet onto which a positive image is transferred from a photosensitive sheet and which is peeled apart from the film unit as a print. One such film unit is known from U.S. Pat. No. 4,490,456 issued on Dec. 25, 1984. In the film unit disclosed in the above-mentioned publication, it is difficult to peel apart the supporting sheet with an image-receiving layer from the film unit because of the photosensitive sheet having the same size as the film unit and the film unit is expensive because of the usage of a large size of photosensitive sheet relative to the effective image-forming area in which an image is formed.

To solve the above-mentioned problems of the conventional monosheet-type self-processing film units, there has been proposed a peelable monosheet type of self-processing photographic film unit (which is hereinafter referred to simply as a peelable film unit) which is disclosed in U.S. patent application Ser. No. 07/269,016 filed on Nov. 9, 1988. Such a peelable film unit basically comprises a photosensitive sheet, which is shorter in length than the film unit, consisting of a supporting sheet on which are formed an image-receiving layer, a peelable interlayer and a photosensitive layer one upon another in that order; a masking sheet having an opening for defining an image-forming area in the photosensitive layer; and a peelable sheet attached to the back surface of the photosensitive sheet by means of an adhesive layer as one integral unit. The peelable film unit is covered with a transparent cover sheet attached to the front surface of the photosensitive sheet. For forming a uniform layer of developing reagent over the image-forming area of the photosensitive layer, an elongated spacer member is interposed along each side of the image-forming area between the photosensitive sheet and the cover sheet.

A problem with peelable film units, is that they are apt to bend at the end of the photosensitive sheet upon being pushed out with a claw to be withdrawn from a film pack. If in fact the film unit bends, it is hard to be grasped by and between a pair of processing rollers.

When manufacturing the peelable monosheet film unit or conventional monosheet film unit, there is the problem of adhering the spacer member to the masking sheet and the cover sheet, because the spacer member is applied with an adhesive layer, such as a hot-melt adhesive layer, to the respective surface, and the simultaneous heating of the respective hot-melt adhesive layers should be avoided. For this reason, the spacer member with hot-melt adhesive layers applied to the respective surfaces is first adhered or welded to the cover sheet, and thereafter the cover sheet is adhered or welded to the masking sheet through the spacer member. In this adhering process, it is necessary to overlap the cover sheet on the masking sheet so as to position exactly the spacer members adhered to the cover sheet on both sides of the image-forming area defining opening. When automatically manufacturing the film units, it is difficult to avoid defective or faulty film units that have inadequately positioned spacer members. To avoid defective film units, positioning means should be provided in the manufacturing apparatus or manufacturing line for exactly overlapping the cover sheet on the masking sheet. This complicates the film unit manufacturing apparatus or manufacturing line.

To manufacture film units at an acceptably rapid rate, it was previously thought that the spacer member should first be attached to the masking sheet. In such a procedure, because of the spacer member applied with hot-melt adhesive layers on both surfaces and being no greater in length than the photosensitive sheet, it is impossible to heat directly the spacer member with a heating head. Accordingly, the photosensitive sheet has to be heated with a heating head to weld the spacer member to the masking sheet. But when heating the photosensitive sheet, the heat transmitted to the spacer member through the photosensitive sheet and the masking sheet is insufficient to weld firmly the spacer member to the masking sheet. This causes a weak adhesion between the spacer member and the masking sheet.

It was also previously proposed to heat the back surface of the masking sheet to weld the spacer member to the front surface of the masking sheet. The back surface of the masking sheet should, however, not be directly heated with the heating head because of the masking sheet having a hot-melt adhesive layer for welding itself to the photosensitive sheet.

OBJECTS OF THE INVENTION

It is, therefore, an object of the present invention to provide a peelable film unit having a desirable degree of stiffness.

It is another object of the present invention to provide a peelable film unit from which a photosensitive sheet providing a print can be easily peeled off.

It is still another object of the present invention to provide a method of making peelable or conventional film units which do not require a special apparatus for controlling the position of spacer members placed on a masking sheet.

SUMMARY OF THE INVENTION

In accordance with the present invention, there is provided a self-processing photographic film unit comprising a masking member formed with an opening; a photosensitive sheet attached to an undersurface of the masking member so as to define an image-forming area within the opening of the masking member, the photosensitive sheet overlapping the margins of the opening; an elongated rupturable pod containing therein a developer reagent and attached to the other or upper surface of the masking member along one end of the image-forming area defining opening; and a trapping member attached to that same other or upper surface of the masking member along the other end of the image-forming area defining opening opposite to said one end for trapping an excess of the developer reagent released from the pod and distributed over the image-forming area of the photosensitive sheet. The photosensitive sheet extends beyond the one end of the image-forming area so as at least partly to overlap the pod via the masking member.

In accordance with another aspect of the invention, there is provided a method of making the self-processing film unit comprising a masking member formed with an image-forming area defining opening, a photosensitive sheet attached to the masking member, a developer containing pod, a trapping member for trapping an excess of the developer reagent released from the pod and distributed over the image-forming area of the photosensitive sheet, a transparent cover sheet attached to the masking member, and a spacer member interposed between the photosensitive sheet and the transparent cover sheet along each side of the image-forming area.

According to a preferred embodiment of that latter aspect of the invention, the method comprises the steps of forming a lengthwise row of the pods at regular spacings along one side of one surface of a long web-like sheet and a lengthwise row of the trapping members at the same regular spacings along the other side of the one surface of the long web-like sheet, the rows being parallel to each other, punching out an image-forming area defining opening in the long web-like sheet between each pod and trapping member, overlapping and attaching a long web-like photosensitive sheet narrower than the long web-like sheet but wider than the image-forming area defining opening onto the other surface of the long web-like member, attaching both ends of a spacer member longer than the width of the long web-like photosensitive sheet to the one surface of the long web-like sheet between each two of the image-forming area defining openings, overlapping and attaching a long web-like transparent sheet having a width narrower than the length of the spacer member but wider than the image-forming area defining openings onto the one surface of the long web-like sheet, folding both sides of the long web-like sheet so as to enclose the lengthwise rows of pods and trapping members, respectively, and cutting the long web-like sheet interposed between the long web-like photosensitive sheet and the long web-like transparent sheet along a center line of each spacer member to separate film units.

DETAILED DESCRIPTION OF THE INVENTION

Figure 1:
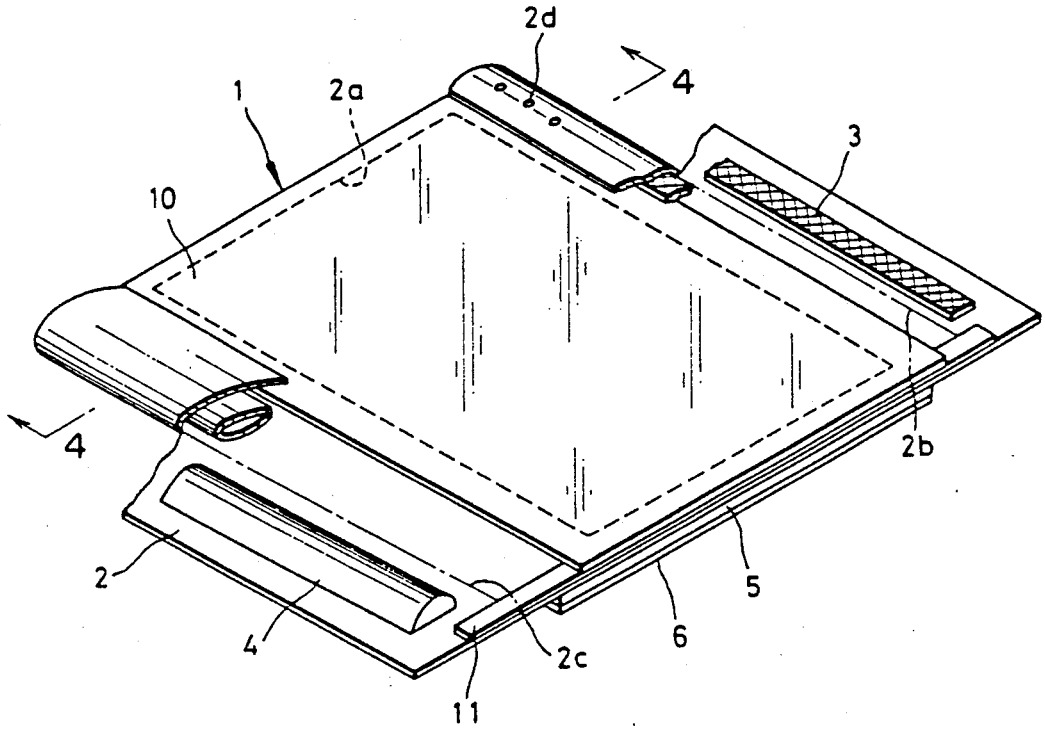
FIG. 1 is a perspective view, partly unfolded, of a peelable film unit according to a preferred embodiment of the present invention.

Referring now to the drawings, in particular to FIGS. 1 to 4, there is shown a peelable film unit 1 having a photosensitive sheet 5 having a thickness of about 100–200 μm, a masking sheet 2 preferably made of a thin semi-transparent plastic sheet, such as a polyethylene terephthalate (PET) sheet, of about 50 μm for defining an image-forming area 2*a* on the photosensitive sheet 5 in which an image is formed, a sealing sheet 6 comprising a peelable sheet (which is hereinafter referred to as a peelable sealing sheet) such as paper adhered to the photosensitive sheet 5 through an adhesive layer and a transparent cover sheet 10 covering the photosensitive sheet 5. The masking sheet 2 has front and rear flaps which are foldable along folding lines 2*b* and 2*c*, respectively. The masking sheet 2 is provided with a rupturable pod 4 containing a processing liquid or viscous developer reagent therein and a trapping member 3 for trapping an excess of developer reagent, each being sandwiched by the associated folded flap. The outer half of the rear flap is formed with a plurality of orifices 2*d* through which air escapes.

The cover sheet 10, which is a relatively thick transparent plastic sheet, such as a polyethylene terephthalate (PET) sheet having a thickness of about 60 μm, is heat-welded or adhered to the masking sheet 2 to cover the whole exposed area of the photosensitive sheet 5. Between the masking sheet 2 and the cover sheet 10 there are blackened spacer members 11, each of which is in the form of a long and relatively thick plastic rail, such as a polyethylene terephthalate (PET) strip having a thickness of about 120 μm, which serves to ensure uniform distribution of the developer reagent over a photosensitive emulsion layer 5*d* of the photosensitive sheet 5. Each spacer member 11 extends near the front and rear edges and is used to structurally reinforce the folded flaps of the masking sheet 2. However, it is not necessary that the spacer members 11 extend from edge to edge of the masking sheet 2: it suffices if they extend only between the folding lines 2*b* and 2*c*.

The photosensitive sheet 5 is heat-welded to the back of the masking sheet 2 with a hot-melt adhesive. The photosensitive sheet 5 consists of a support sheet 5*a* made of a waterproof sheet, such as a polyethylene terephthalate sheet, an image-receiving layer 5*b* coated on the supporting sheet 5*a*, a peelable interlayer 5*c* coated on the image-receiving layer 5*b*, and a photosensitive emulsion layer 5*d* coated on the peelable interlayer 5*c*. The photosensitive emulsion layer 5*d* of the photosensitive sheet 5 is heat-welded to the back of the masking sheet 2 with a hot-melt adhesive. The peelable sealing sheet 6 comprises a peelable sheet 9 attached to the back of the supporting sheet 5*a* with an adhesive layer 8.

Figure 4:
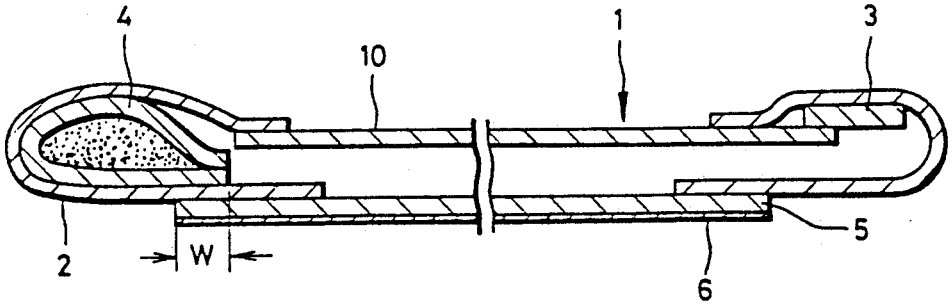
FIG. 4 is a cross sectional view taken along line IV—IV of FIG. 1.
Figure 2:
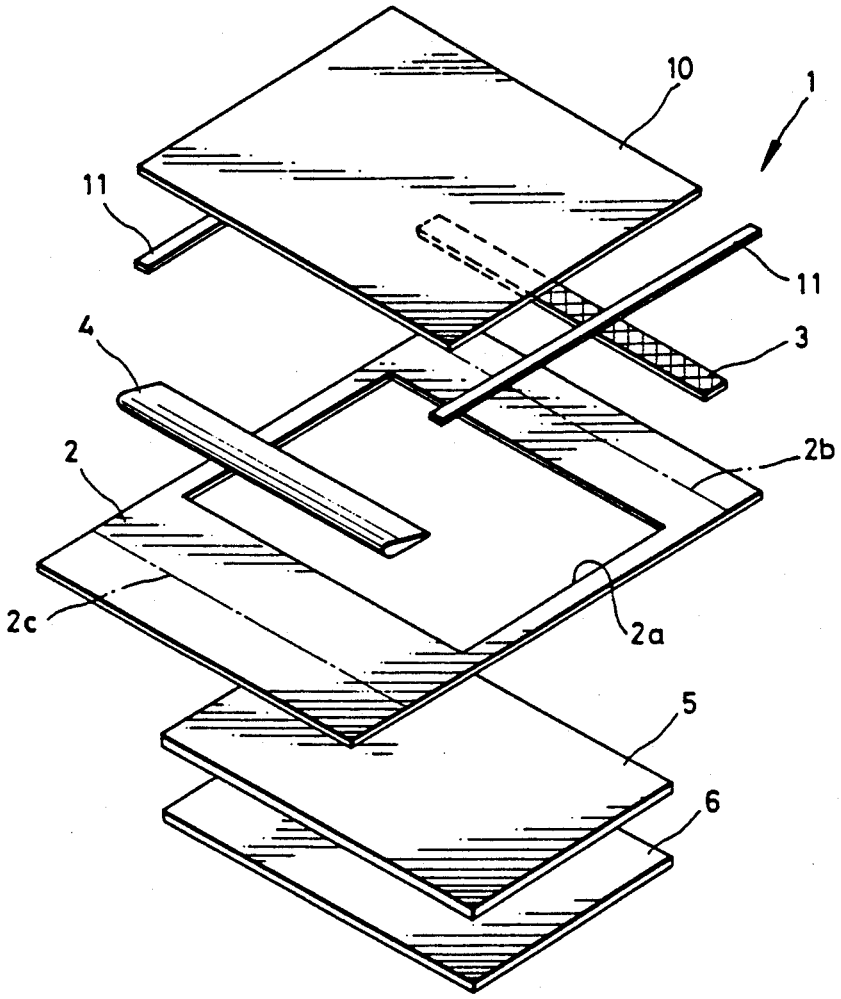
FIG. 2 is a perspective exploded view of the peelable film unit shown in FIG. 1.
Figure 3:
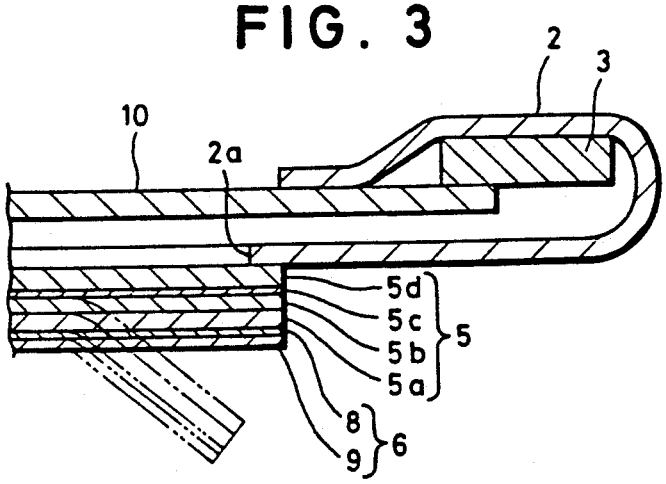
FIG. 3 is a cross sectional view of part of the peelable film unit shown in FIG. 1.

As is shown in FIG. 4, the front end portions of the photosensitive sheet 5 and the peelable sealing sheet 6 underlap the rear portion of the rupturable pod 4 by a length W, so as to strengthen the part of the masking sheet 2 between the rupturable pod 4 and the image-forming area 2*a*. This prevents the film unit 1 from being bent at the border thereof between the rupturable pod 4 and the photosensitive sheet 5 upon being withdrawn from a film pack or upon being bitten between spring-loaded juxtaposed processing rollers which are well known in the instant photographic art and therefore not shown. In addition, the length of the photosensitive sheet 5 is shorter than the overall length of the film unit 1 between the folding lines 2b and 2c of the masking sheet 2 for saving the materials of the photosensitive emulsion layer 5d and the image-receiving layer 5b, which are generally expensive. Because the elemental sheets of the peelable film unit 1 differ stepwise in length, not only is the front or leading edge of the peelable film unit 1 bitten or grasped between the processing rollers without slippage but it also is ensured that the image-receiving layer 5b can be peeled from the photosensitive emulsion layer 5d without the latter being torn off from the masking sheet 2.

The peelable film unit 1 thus constructed is exposed through the transparent cover sheet 10. After exposure, the peelable film unit 1 is withdrawn from a camera or film holder (which is not shown but may be of any well known type of instant camera or film holder therefor). The leading edge of the peelable film unit 1 is grasped by the conventional pair of spring-loaded juxtaposed processing rollers of the camera or film holder. The front end portion of the peelable film unit 1 is passed between and by the processing rollers of the camera or film holder to break the rupturable pod 4 containing developer reagent so as to release the developer reagent and spread it between the photosensitive emulsion layer 5d and the cover sheet 10. Because the front folded lap of the masking sheet 2 is reinforced by the spacer members 11, the front end portion of the peelable film unit 1 has a rigidity sufficient to be grasped without being bent even though the photosensitive sheet 5 is shorter than the peelable film unit 1.

Upon the withdrawal of the peelable film unit 1 between the processing rollers, the developer reagent is spread and distributed between the photosensitive sheet 5 and the cover sheet 10 and an excess of the developer reagent escapes by passing between the trailing ends of the cover sheet 10 and the masking sheet 2 and is captured by the trapping member 3. After a predetermined time, the diffusion transfer process is completed to transfer the latent image formed in the photosensitive layer 5d to the image-receiving layer 5b through the peelable interlayer 5c, thereby providing a visible positive image on the image-receiving layer 5b.

The photosensitive sheet 5 is then peeled from the film unit 1 and, thereafter, the peelable sealing sheet 6 is peeled from the supporting sheet 5a with the image-receiving layer 5b. In this manner, the supporting sheet 5a, which bears the image-receiving layer 5b and the adhesive layer 8 on its opposite surfaces, respectively, is left as a self-adhesive print. The supporting sheet 5a, in the form of this self-adhesive print, can be attached to an album or the like without applying any paste.

Figure 5:
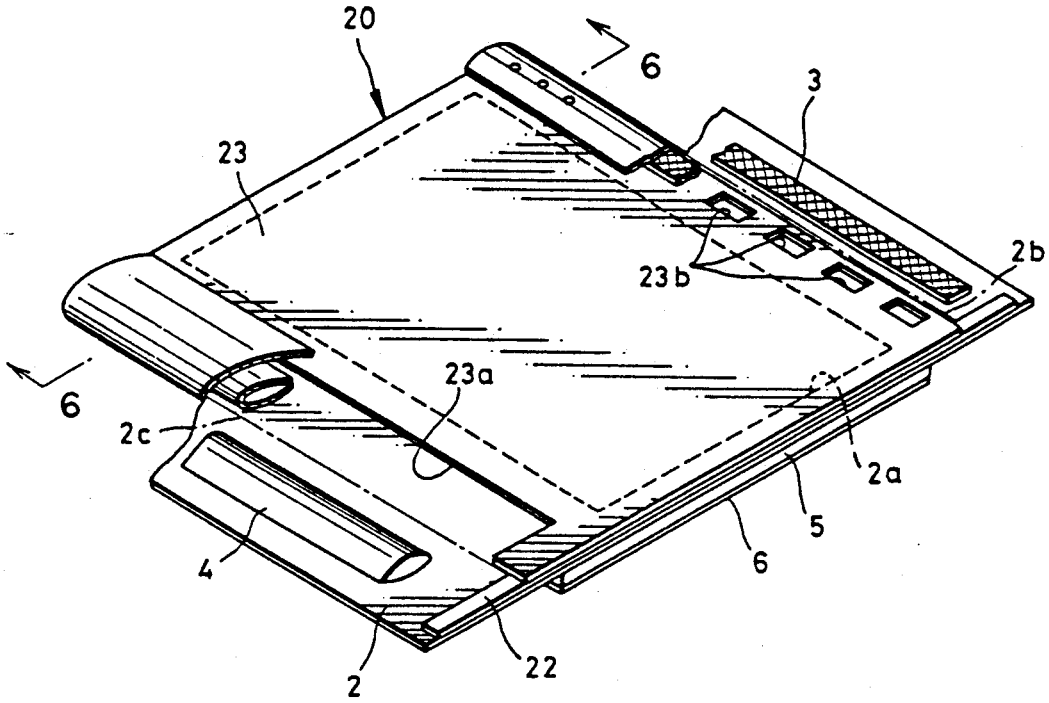
FIG. 5 is a perspective view, partly unfolded, of a peelable film unit according to another preferred embodiment of the present invention.
Figure 6:
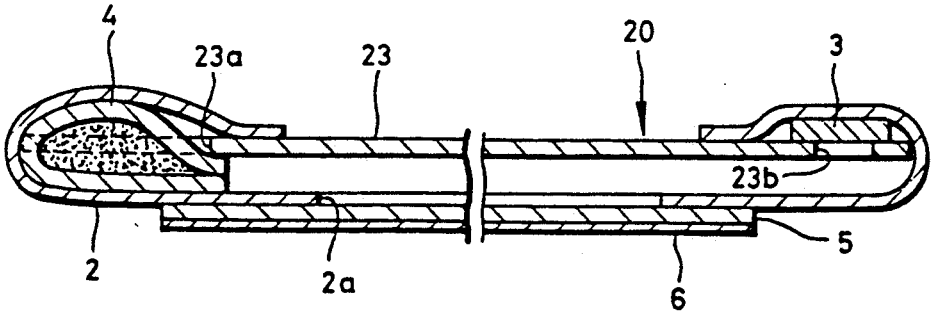
FIG. 6 is a cross-sectional view taken along line VI—VI of FIG. 5.
Figure 7:
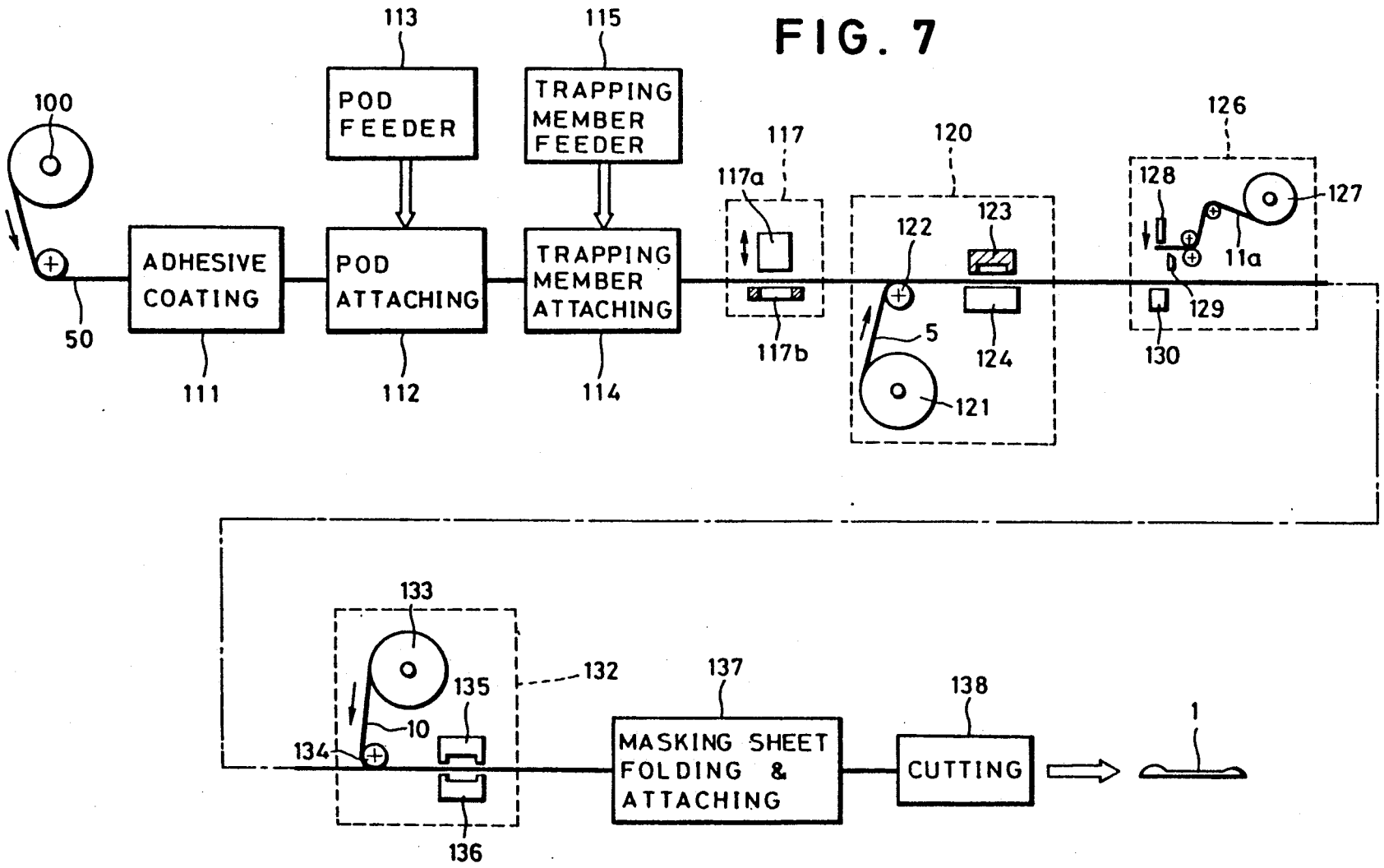
FIG. 7 is a block diagram illustrating a manufacturing line embodying a method of making the peelable film unit shown in FIG. 1 in accordance with the present invention.

Referring to FIGS. 5 and 6, there is shown a peelable film unit 20 according to an alternative embodiment of the present invention. Because the film unit 20 has the same structure as that of the film unit 1 of the previous embodiment excepting a transparent cover sheet 23 and spacer members 22, the following description will be addressed to the transparent cover sheet 23 and the spacer members 22. The spacer members 22 extend near the front and rear edges of the masking sheet 2 and are folded back along the folding lines 2b and 2c to overlie the end portions of the transparent cover sheet 23.

The transparent cover sheet 23 extends in a lengthwise direction up to the folding lines 2b and 2c. The transparent cover sheet 23 is formed with a cut-away portion 23a for receiving therein the rupturable pod 4 in one end portion and with a plurality of openings 23b in the opposite end portion. An excess of developer reagent passes through the openings 23b and is trapped by the trapping member 3. Because of the endwise extension of the transparent cover sheet 23 and the spacer members 22, the film unit 20 is strengthened at the opposite end portions, whereby the film unit 20 is prevented from being deformed or bent when forced by a claw member engaging a rear end of the film unit 20, so that the withdrawal of the film unit is ensured. It is not always necessary that the spacer members 22 and the transparent cover sheet 23 all extend between and to the folding lines 2b and 2c of the masking sheet 2: it suffices if any one of them extends between and to the folding lines 2b and 2c. To increase the strength of the whole film unit, it is desirable to use an increased thickness of masking sheet.

Figure 8:
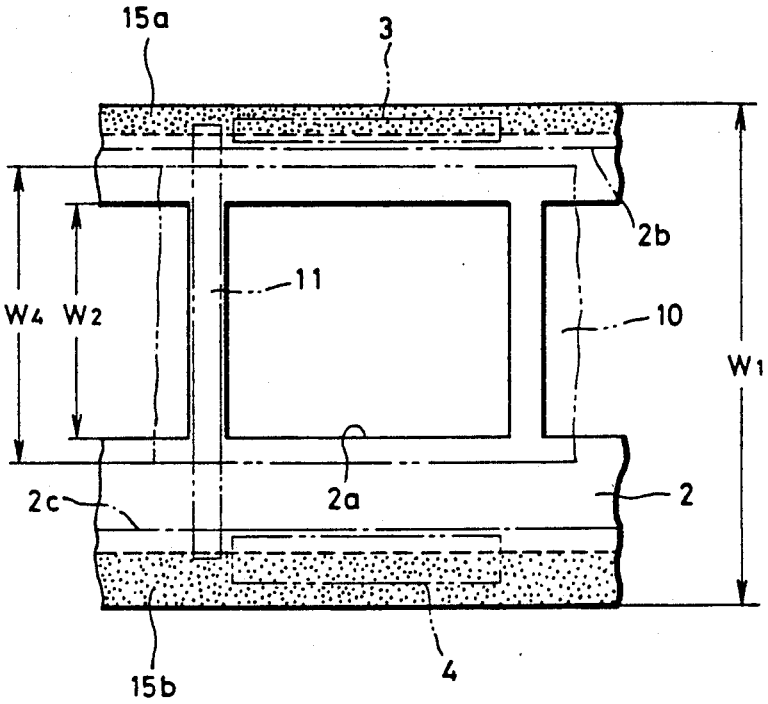
FIG. 8 is an explanatory illustration showing part of the upper surface of a masking sheet member with a pod, a trapping member and spacer members attached thereto.
Figure 9:
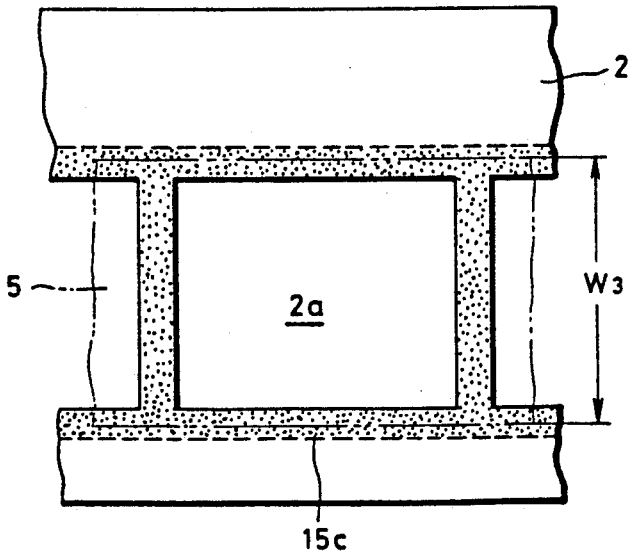
FIG. 9 is an explanatory illustration showing part of the back surface of a masking sheet member with a photosensitive sheet attached thereto.

Referring to FIGS. 7 to 11, a manufacturing line for performing a method of assembling and making the film unit 1 shown in FIG. 1 in accordance with a preferred embodiment of the present invention is shown, consisting of nine stations. A roll of web-like masking sheet member 50, such as a semi-transparent polyethylene terephthalate (PET) film having a thickness of about 50 μm and a width W1 and wound around a core rod 100, from which the masking sheets 2 are made, is continuously withdrawn and transported to an adhesive applying station 111 where hot melt adhesive is applied to both surfaces of the masking sheet member 50. That is, hot-melt adhesive is applied to both side margins 15a and 15b of the upper surface as shown in FIG. 8 and to a frame-forming area 15c of the under surface as shown in FIG. 9.

Figure 11:
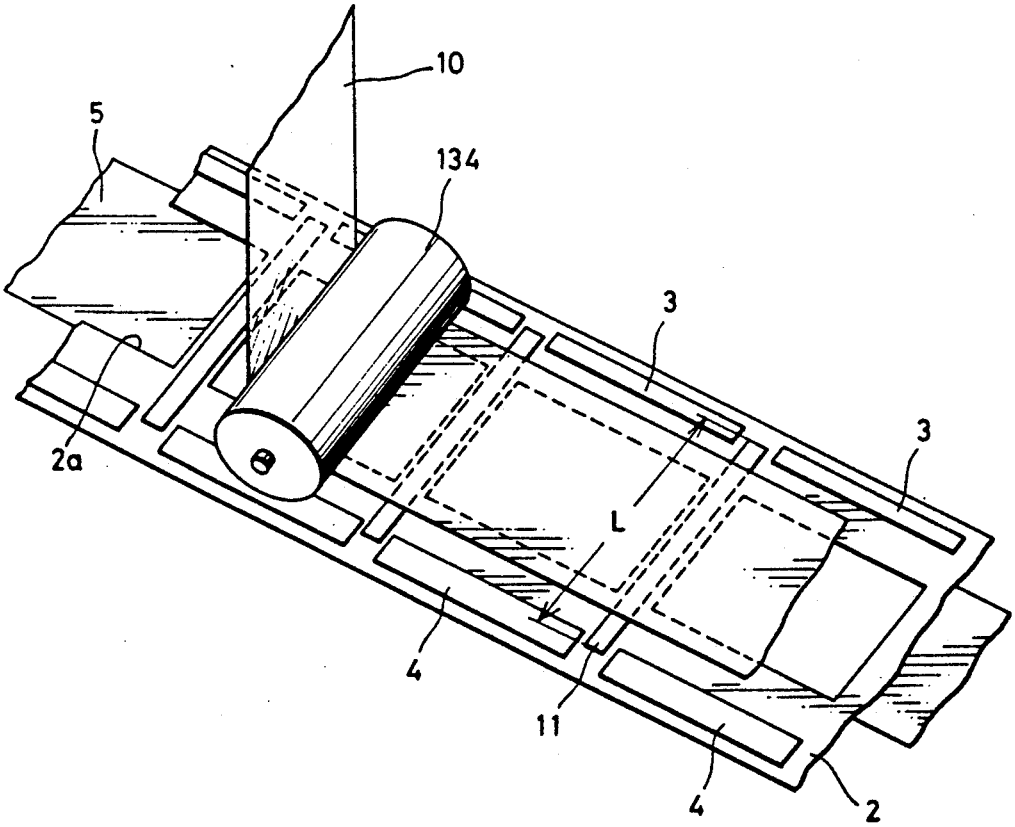
FIG. 11 is a perspective view showing a process of overlapping a cover sheet on the masking sheet member.

The masking sheet member 50 is advanced to a pod attaching station 112 where pods 4 containing processing reagent are supplied from a pod feeder 113 and attached to the upper surface of the masking sheet member 50 at regular spacings. To attach the pod 4, the pod 4 is placed on that part of the upper surface of the masking sheet member 50 which will be forward of (that is, to the lower left as seen in FIG. 11) the folding line 2c and the adjacent end part of the masking sheet member 50 is heated for a short period of time with a heater from the back side so as weakly to bond the pod 4 to the masking sheet member 50. After attaching the pod 4 to the masking sheet member 50, the masking sheet member 50 is advanced to a trapping member attaching station 114 wherein trapping members 3 are supplied from a trapping member feeder 115 and attached by heat welding to the rear end part of the upper surface of the masking sheet member 50 which will be to the rear of (that is, to the upper right as seen in FIG. 11) the folding line 2b at regular spacings. At a punching station 117 wherein a punching machine consisting of a punching die 17a and a punching block 17b is disposed, the masking sheet member 50 is formed with openings 2a defining image forming areas of width W2 at regular spacings, whereby a series of consecutive masking sheets is formed.

The series of masking sheet members 50 with the pods 4 and the trapping members 3 attached thereto and formed with the image-forming area defining openings 2a is advanced to a photosensitive sheet laminating section 120 wherein a roll of web-like photosensitive sheet 5 having a thickness of about 100–200 μm and a width W3 and a heat-welding unit are provided. The heat-welding unit consists of a support table 124 and a heating head 123. The photosensitive sheet 5 is withdrawn from a roll 121 and laminated onto the under surface of the masking sheet member 50 by means of a roller 122. The photosensitive sheet 5 laminated on the masking sheet member 50 is passed over the support table 124 and pressed by means of the heating head 123. Because the masking sheet member 50 has been coated with hot-melt adhesive in the frame-forming area 15*c*, the photosensitive sheet 5 is heat-bonded to the photosensitive sheet 5 so as to underlie each image-forming area defining opening 2*a*.

At a spacer member attaching station 126, a spacer member 11 is temporarily attached to the upper surface of the masking sheet member 50 between each two adjacent image-forming area defining openings 2*a*. The spacer member 11 is provided by cutting a narrow long spacer material 11*a* with a hot-melt adhesive layer on each surface in a roll 127 to a predetermined length L greater than the width W3 of the photosensitive sheet 5 and also greater than the distance between the front and rear folding lines 2*b* and 2*c*. The spacer material 11*a* is held and forced down by means of an air suction head 128. During the downward movement of the air suction heat 128, a cutter 129 cuts off the spacer material 11*a* to form a spacer member 11 such as a polyethylene terephthalate (PET) strip having a thickness of about 60 μm and having the length L. Because the spacer member 11 extends beyond the front and rear folding lines of the masking sheet 10 to which the masking sheet member 50 will be cut, the front and rear parts of the film unit 1 to be folded back are resistant to bending and the sealing of processing reagent in the film unit will be ensured.

Figure 10:
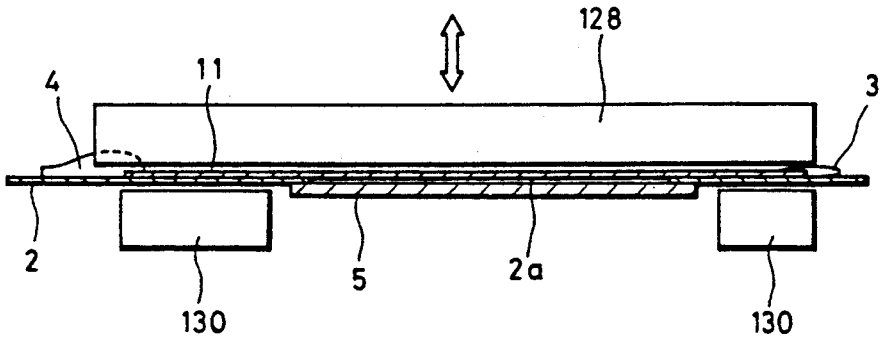
FIG. 10 is an enlarged illustration explaining a process of welding the spacer member to the masking sheet member.

As is shown in detail in FIG. 10, a spacer member 11 is held by the air suction head 128 and pressed down against the upper surface of the masking sheet member 50 along the side of the image-forming area defining opening 2*a* and between each adjacent pair of openings 2*a*. Heating heads 130, which are disposed on each side of the opening 2*a* on opposite sides of the width of photosensitive sheet 5, heat the end parts only of the hot-melt adhesive layer on the under surface of the spacer member 11, thereby only partly bonding or welding the spacer member 11 to the upper surface of the masking sheet member 50. It is to be noted that heating the hot-melt adhesive layer on the under surface of the spacer member 11 is performed for only a short period of time so as not to melt the hot-melt adhesive layer on the upper surface of the spacer member 11.

After the partial welding of the spacer member 11 at its ends to sheet member 50, the latter is advanced to a cover sheet attaching station 132 wherein a long web-like transparent sheet 10, such as a polyethylene terephthalate (PET) film having a thickness of about 120 μm and a width W4 between the widths W1 and W2, wound in a roll 133 and a heat-welding unit are provided. The heat-welding unit consists of a support table 136 and a heat head 135. In the cover sheet attaching station 132, the transparent sheet 10 is withdrawn from the roll 133 and superposed on the masking sheet member 50 by means of a roller 134. The transparent sheet 10 superposed on the masking sheet member 50 is passed over the support table 136 and pressed by means of the heating head 135, thus being welded to the upper surface of the masking sheet member 50 via the spacer members 11.

Thereafter, the masking sheet member 50 with all its elements attached thereto is subjected to a folding process at a folding station 137. The masking sheet member 50, which consists of a continuous series of film unit sets, is folded lengthwise, namely along the folding lines, so as to sandwich the pod 4 and the trapping member 3 between the unfolded portions of masking sheet member 50 and the folded portions thereof, respectively, and the edges of the folded portions of the masking sheet member 50 overlap and are attached to the upper surface of the transparent sheet 10 along or adjacent opposite longitudinal edges of the latter. Then, a generally U-shaped heating head (not shown) is placed on the masking sheet member 50 so as to heat the folded and overlapping portions of the masking sheet member 50 and the spacer members 11, thus heat-welding the transparent cover sheet member 10 and the spacer members 11 to the masking sheet member 50. Finally, the masking sheet member 50 comprising an integral series of a number of film unit sets is cut along the lengthwise center line of each spacer member 11 into individual film units 1 at a cutting station 138.

Although the above-described method relates to peelable monosheet film units, it can be also used for conventional monosheet film units in which an image-receiving layer is not peeled off from a photosensitive layer after developing.

The present invention has been fully described with particular reference to preferred illustrative embodiments thereof, but it will be understood that variations and modifications can be effected within the scope of the invention.

What is claimed is:

1. In a self-processing photographic film unit comprising a masking member formed with an opening; a photosensitive sheet attached to one surface of said masking member about said opening so that said opening defines an image-forming area on said photosensitive sheet; an elongated rupturable pod containing therein a developer reagent and attached to the other surface of said masking member along one end of said image-forming area; and a trapping member attached to said other surface of said masking member along the other end of said image-forming area opposite to said one end for trapping an excess of said developer reagent released from said pod and distributed over said image-forming area of said photosensitive sheet; the improvement in which said photosensitive sheet has an extended part that underlies only that part of said pod which is nearest said image-forming area.

2. A self-processing photographic film unit as defined in claim 1, wherein said pod and said trapping member are enclosed within envelopes formed by folded over respective opposite ends of said masking member.

3. A self-processing photographic film unit as defined in claim 1, wherein said photosensitive sheet comprises a photosensitive emulsion layer, an image-receiving layer, and a peelable layer, and said image-receiving layer is peeled off from said peelable layer for observation after completion of said developing.

4. A self-processing photographic film unit as defined in claim 1, wherein said spacer member extends beyond said one end of said image-forming area sufficiently to be folded when said ends of said masking member are folded to form said envelope wherein said pod is enclosed.

5. A self-processing photographic film unit as defined in claim 4, wherein a transparent cover sheet is attached to said masking member and extends within said envelope.

6. A self-processing photographic film unit as defined in claim 4, wherein said masking member is formed at one end with a cut-away portion for receiving said pod.

7. A self-processing photographic film unit as defined in claim 6, wherein said masking member is formed at said other end with a plurality of openings which overlap said trapping member.

8. A self-processing photographic film unit as defined in claim 6, wherein said masking member is formed at said other end with a plurality of air escape openings.

9. A method of making a self-processing film unit comprising a masking member formed with an image-forming area defining opening, a photosensitive sheet attached to said masking member, a pod containing a developer, a trapping member for trapping an excess of said developer released from said pod and distributed over said image-forming area of said photosensitive sheet, a transparent cover sheet attached to said masking member, and a spacer member interposed between said photosensitive sheet and said transparent cover sheet along each side of said image-forming area, said method comprising the steps, in the hereinafter-recited sequence, of:

forming a lengthwise row of said pods at regular spacings along one side of one surface of a long web-like sheet and a lengthwise row of said trapping members at said regular spacings along the other side of said one surface of said long web-like sheet, said rows being parallel to each other;

punching out an image-forming area defining opening in said long web-like sheet between each pair comprised by a said pod and trapping member;

laminating a long web-like photosensitive sheet narrower than said long web-like sheet but wider than said image-forming area defining opening onto the other surface of said long web-like member;

attaching both ends of a spacer member of a length greater than the width of said long web-like photosensitive sheet to said one surface of said long web-like sheet between each two adjacent said image-forming area defining openings;

laminating a long web-like transparent sheet having a width less than the length of said spacer member but greater than that of said image-forming area defining openings onto said one surface of said long web-like sheet;

folding both sides of said long web-like sheet so as to enclose said lengthwise rows of pods and trapping members, respectively; and cutting the device produced by said folding along a center line of each spacer member to separate film units.

* * * * *